US006073461A

United States Patent [19]

McNeil et al.

[11] Patent Number: 6,073,461

[45] Date of Patent: Jun. 13, 2000

[54] SEPARATION OF CARBON MONOXIDE FROM NITROGEN-CONTAMINATED GASEOUS MIXTURES ALSO CONTAINING HYDROGEN AND METHANE

[75] Inventors: Brian Alfred McNeil, Chessington; Eric William Scharpf, Walton-on-Thames, both of United Kingdom

[73] Assignee: Air Products and Chemicals, Inc., Allentown, Pa.

[21] Appl. No.: 09/224,690

[22] Filed: Jan. 4, 1999

[30] Foreign Application Priority Data

Jan. 13, 1998 [GB] United Kingdom ..... 9800692

[51] Int. Cl.[7] ..... F25J 1/00

[52] U.S. Cl. ..... 62/625; 62/632; 62/920

[58] Field of Search ..... 62/625, 632, 635, 62/920

[56] References Cited

U.S. PATENT DOCUMENTS

| | | | |
|---|---|---|---|
| 4,311,496 | 1/1982 | Fabian | 62/920 |
| 4,478,621 | 10/1984 | Fabian | 62/31 |
| 5,351,491 | 10/1994 | Fabian | 62/920 |
| 5,351,492 | 10/1994 | Agrawal et al. | 62/920 |
| 5,359,857 | 11/1994 | Honda | 62/920 |
| 5,592,831 | 1/1997 | Bauer et al. | 62/625 |

FOREIGN PATENT DOCUMENTS

| | | | |
|---|---|---|---|
| 0676373A1 | 11/1995 | European Pat. Off. | C01B 31/18 |
| 1954133A1 | 7/1997 | Germany | C01B 31/18 |

*Primary Examiner*—Ronald Capossela
*Attorney, Agent, or Firm*—Willard Jones, II

[57] ABSTRACT

Carbon monoxide is separated from a gaseous mixture containing hydrogen and methane and contaminated with nitrogen by scrubbing carbon monoxide from a vapor portion of the feed by a liquid methane wash; stripping dissolved hydrogen from the resultant CO-loaded liquid methane stream; fractionating the resultant hydrogen-stripped CO-loaded liquid methane stream to separate nitrogen therefrom; and fractionating the resultant nitrogen-freed bottoms liquid into CO product overheads vapor and methane bottoms liquid. If the gaseous mixture also contains argon, argon content can be removed with the methane content to obviate a separate argon-separation stage as required by prior art processes.

16 Claims, 2 Drawing Sheets

SEPARATION OF CARBON MONOXIDE FROM NITROGEN-CONTAMINATED GASEOUS MIXTURES ALSO CONTAINING HYDROGEN AND METHANE

TECHNICAL FIELD OF THE INVENTION

The present invention relates to the separation of carbon monoxide from gaseous mixtures containing carbon monoxide ("CO"), hydrogen, methane and nitrogen. It has particular, but not exclusive, application to the separation of carbon monoxide from synthesis gas consisting essentially of carbon monoxide, hydrogen and methane but contaminated with nitrogen, especially when co-contaminated with argon.

BACKGROUND OF THE INVENTION

Carbon monoxide is usually obtained by separation from synthesis gases produced by catalytic conversion or partial oxidation of natural gas, oils or other hydrocarbon feedstock. In addition to carbon monoxide, these gases contain primarily hydrogen and methane but are often contaminated with significant amounts of nitrogen (derived from the feed or added during processing). Conventional cryogenic separation processing leaves nitrogen as an impurity in the carbon monoxide, which, for both environmental and processing reasons, is unacceptable for some uses of carbon monoxide. The problem of nitrogen contamination of carbon monoxide product is becoming an increasing problem with the usage of more marginal feed stock in front end reforming processes. Further, there is an increasing demand for carbon monoxide to be free of argon, which usually is a co-contaminant with nitrogen. Accordingly, there is a demand for efficient and effective removal of contaminant nitrogen and, if required, argon from carbon monoxide-containing feeds.

The separation of nitrogen alone or with argon co-contaminant from carbon monoxide is relatively difficult compared to removal of hydrogen or methane. Prior art processes for removing nitrogen from synthesis gas usually include the sequential steps of removing hydrogen from the synthesis gas feed, removing methane from the resultant hydrogen-freed stream, and removing nitrogen from the resultant hydrogen- and methane-freed stream to leave a purified CO product stream.

U.S. Pat. No. 4,478,621 discloses such a process for the recovery of carbon monoxide in which synthesis gas feed is partially condensed and the resultant two phase mixture fed to a wash column in which carbon monoxide is scrubbed from the vapor phase by contact with a liquid methane stream to provide CO-loaded methane containing some, typically 3–4%, hydrogen. A CO recycle heat pump stream provides intermediate indirect cooling to the wash column to remove the heat of solution of carbon monoxide in methane. Residual hydrogen is removed from the CO-loaded methane in a stripping column to meet the required carbon monoxide product specification. The hydrogen-stripped CO-loaded methane is separated into nitrogen-contaminated carbon monoxide overheads vapor and methane-rich bottoms liquid in a methane-separation fractionation column in which both overheads cooling and bottoms reboil is indirectly provided by the CO recycle heat pump stream. Nitrogen is removed from the carbon monoxide overheads in a nitrogen/CO fractionation column to provide CO product bottoms liquid. Overheads cooling to the nitrogen/CO fractionation column is indirectly provided by expanded CO product bottoms liquid and bottom reboil is directly provided by the CO recycle heat pump stream.

EP-A-0676373 discloses a similar process for the recovery of carbon monoxide but in which hydrogen is separated from synthesis gas feed by partial condensation. The condensate is separated into nitrogen-contaminated carbon monoxide overheads vapor and methane-rich bottoms liquid in a methane-separation fractionation column. Nitrogen is removed from the carbon monoxide overheads in a nitrogen/CO fractionation column to provide CO product bottoms liquid. Partial condensation of overheads from at least one of said fractionation columns and bottoms reboil to the nitrogen/CO fractionation column are provided by a CO recycle heat pump stream. In one embodiment (FIG. 5), CO product bottoms liquid from the nitrogen/CO fractionation column is further distilled in an argon/CO fractionation column to provide argon-freed CO overheads vapor and an argon-enriched bottoms liquid. Bottoms reboil for the argon/CO fractionation column also is provided by the CO recycle heat pump stream.

The stated characterising feature of the process of EP-A-0676373 is reduction of energy consumption and plant capital cost by providing overheads condensation for only one of said separation columns and refluxing the other of said columns with liquid extracted at an intermediate location of the said column having overheads condensation. However, it does describe a process (FIG. 2) which does not have said reflux feature but partially condenses overheads of both the methane- and nitrogen-separation columns.

U.S. Pat. No. 5,592,831 discloses a process for recovering carbon monoxide from a feed containing at least hydrogen, carbon monoxide and methane. The feed is cooled and partially condensed and then scrubbed with liquid methane. Dissolved hydrogen in the resultant CO-loaded liquid methane stream is stripped and the hydrogen-stripped CO-loaded liquid methane stream is rectified into a CO-enriched vapor and a methane-enriched bottoms liquid. The characterizing feature of the process is that the liquid methane used to scrub the partially condensed feed contains at least 2 to 15 mol % CO. In practice, the scrubbing liquid is a major portion of the methane-enriched bottoms liquid from the rectification.

DE-A-19541339 discloses a process for removing nitrogen from synthesis gas in which the synthesis gas feed is partially condensed and hydrogen is removed from the condensed fraction in a stripping column to provide a hydrogen-freed CO-rich liquid. Nitrogen is separated from said CO-rich liquid in a nitrogen-separation fractionation column to provide a nitrogen-freed CO-rich bottoms liquid. Part of said nitrogen-freed CO-rich bottoms liquid is vaporized and both the vaporised and remaining (liquid) portions are fed to a methane-separation fractionation column to provide CO product overheads vapor and methane bottoms liquid. Optionally, additional CO is recovered from the hydrogen-rich vapor portion of said partial condensation of the synthesis gas feed by, for example, pressure swing adsorption or membrane separation and processing of the flush gas or membrane retentate.

Reboil to all three columns of DE-A-19541339 is provided by vaporizing a portion of the respective bottoms liquid and returning the vaporized portion to the relevant column. In one embodiment (FIG. 1), heat duty for the reboil of all three columns and condensation duty for reflux of the nitrogen-separation column is provided by a CO recycle heat pump stream, which also directly provides reflux to the methane-separation column. In remaining embodiments (FIGS. 2 & 3), heat duty for the reboil of all three columns and condensation duty for reflux of both the nitrogen- and methane-separation columns is provided by a (nitrogen) closed circuit heat pump stream.

A specified advantage of the process of DE-A-19541339 is the absence of a methane wash. In particular, it is stated that the successive nitrogen- and methane-separation fractionations avoid the use of a methane wash and thereby saves both capital and energy costs. However, in the absence of the optional recovery of CO from the hydrogen-rich vapor fraction of the synthesis gas feed, the CO yield of the process is only about 85%. The optional additional recovery of CO from the hydrogen-rich vapor fraction can increase the yield to about 97% but at the expense of additional capital and energy costs.

It is an object of the present invention to provide a more cost effective process for separating carbon monoxide from gaseous mixtures containing carbon monoxide, hydrogen, methane and nitrogen, especially those which also contain argon.

SUMMARY OF THE INVENTION

It has now been found that, contrary to the teaching of DE-A-19541339, it is often more cost-effective to employ a methane wash when the methane content of the synthesis gas feed exceeds about 1 mol-%, especially when the synthesis gas has a high hydrogen:CO molar ratio (above about 2.5:1; especially 3:1–6:1). The use of a methane wash reduces (recoverable) CO losses with the hydrogen product stream thereby obviating, or at least reducing, the need to recycle that stream to obtain high CO yields.

Thus, according to a first general aspect, the present invention provides a process for separating carbon monoxide from a gaseous mixture containing carbon monoxide, hydrogen, methane and nitrogen by cryogenic separation in which:

- carbon monoxide is scrubbed from a vapor portion of the feed by a liquid methane wash to provide a CO-loaded liquid methane stream and a hydrogen-rich vapor;
- dissolved hydrogen is stripped from said CO-loaded liquid methane stream to provide a hydrogen-stripped CO-loaded liquid methane stream;
- said hydrogen-stripped CO-loaded liquid methane stream is fractionated into nitrogen-containing overheads vapor and nitrogen-freed bottoms liquid; and
- said nitrogen-freed bottoms liquid is fractionated into CO product overheads vapor and methane bottoms liquid.

In a second general aspect, the invention provides an apparatus for separating carbon monoxide from a gaseous mixture containing carbon monoxide, hydrogen, methane and nitrogen by a process of the invention, said apparatus comprising:

- scrubbing means for scrubbing carbon monoxide from the vapor portion of the feed by the liquid methane wash to provide the CO-loaded liquid methane stream and the hydrogen-rich vapor;
- stripping means for stripping dissolved hydrogen from the CO-loaded liquid methane stream to provide the hydrogen-stripped CO-loaded liquid methane stream;
- nitrogen-separation fractionation means for separating nitrogen from the hydrogen-stripped CO-loaded liquid methane stream into the nitrogen-containing overheads vapor and the nitrogen-freed bottoms liquid; and
- methane-separation fractionation means for separating the nitrogen-freed bottoms liquid into the CO product overheads vapor and the methane bottoms liquid.

DETAILED DESCRIPTION OF THE INVENTION

Figure 1:
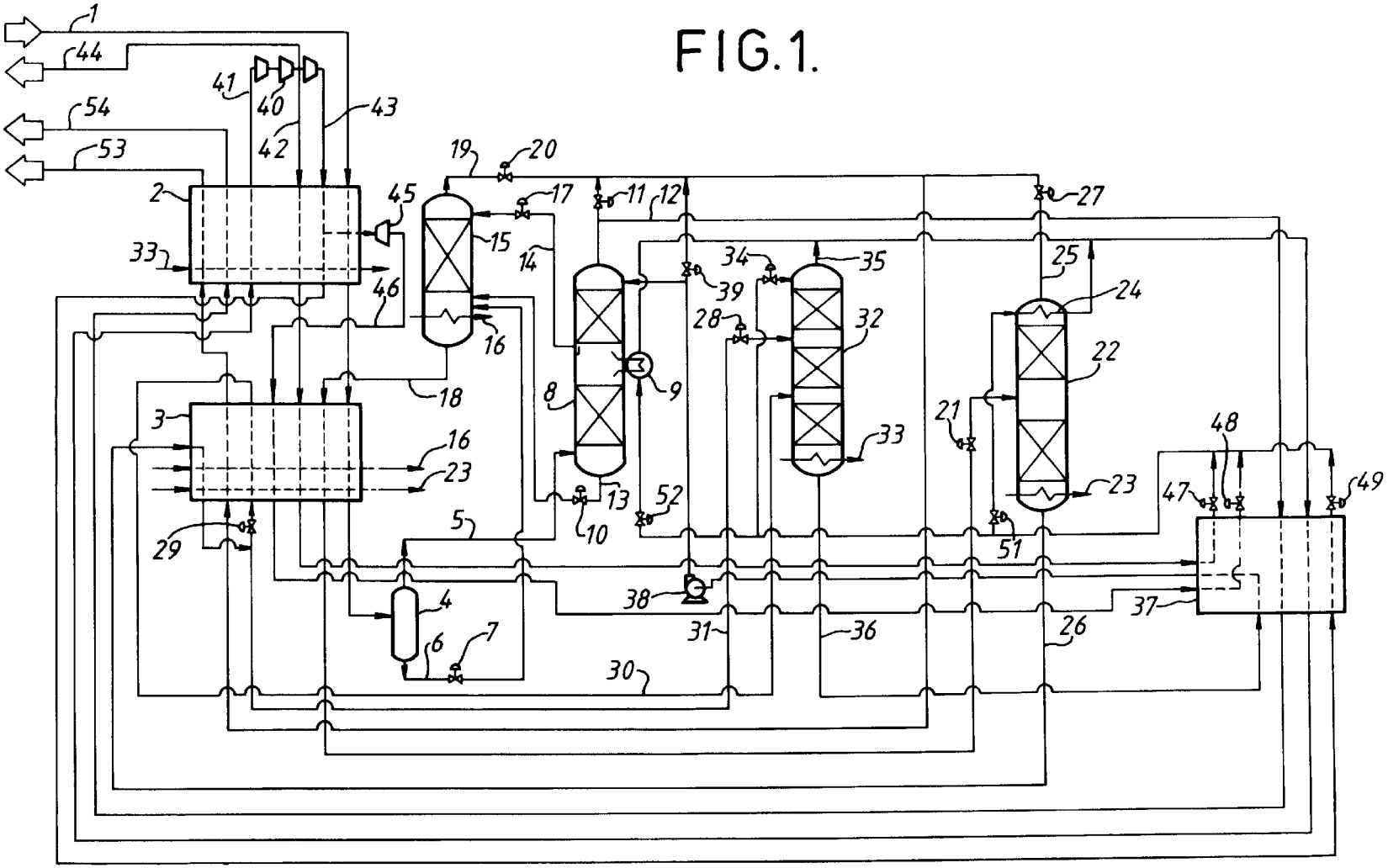
FIG. 1 is a schematic representation of one preferred embodiment of the present invention and FIG. 2 is a schematic representation of another preferred embodiment of the present invention.

The present invention provides an improvement in prior art processes for cryogenic separation of carbon monoxide from a gaseous mixture containing carbon monoxide, hydrogen, methane and nitrogen in which carbon monoxide is scrubbed from the feed using a methane wash and methane and nitrogen contents are separately separated from the CO-loaded methane wash liquid. The improvement is conducting the nitrogen separation before the methane separation.

The present invention correspondingly provides an improvement in an apparatus for separating carbon monoxide from a gaseous mixture containing carbon monoxide, hydrogen, methane and nitrogen and comprising a scrubbing column for scrubbing carbon monoxide from the feed by the liquid methane wash; a methane-separation column for separating methane content from carbon monoxide content and a nitrogen-separation column for separating nitrogen content from carbon monoxide content. The improvement is locating the nitrogen-separation column upstream of the methane-separation column.

In a first general aspect, the present invention provides a process for separating carbon monoxide from a gaseous mixture containing carbon monoxide, hydrogen, methane and nitrogen by cryogenic separation in which:

- carbon monoxide is scrubbed from a vapor portion of the feed by a liquid methane wash to provide a CO-loaded liquid methane stream and a hydrogen-rich vapor;
- dissolved hydrogen is stripped from said CO-loaded liquid methane stream to provide a hydrogen-stripped CO-loaded liquid methane stream;
- said hydrogen-stripped CO-loaded liquid methane stream is fractionated into nitrogen-containing overheads vapor and nitrogen-freed bottoms liquid; and
- said nitrogen-freed bottoms liquid is fractionated into CO product overheads vapor and methane bottoms liquid.

In a second general aspect, the invention provides an apparatus for separating carbon monoxide from a gaseous mixture containing carbon monoxide, hydrogen, methane and nitrogen by a process of the invention, said apparatus comprising:

- a scrubbing column constructed and arranged to scrub carbon monoxide from the vapor portion of the feed by the liquid methane wash to provide the CO-loaded liquid methane stream and the hydrogen-rich vapor;
- a stripping column constructed and arranged to strip dissolved hydrogen from the CO-loaded liquid methane stream to provide the hydrogen-stripped CO-loaded liquid methane stream;
- a nitrogen-separation fractionation column constructed and arranged to separate nitrogen from the hydrogen-stripped CO-loaded liquid methane stream into the nitrogen-containing overheads vapor and the nitrogen-freed bottoms liquid; and
- a methane-separation fractionation column constructed and arranged to separate the nitrogen-freed bottoms liquid into the CO product overheads vapor and the methane bottoms liquid.

Advantages of the column arrangement used in the present invention include the reduction in heat pump duty because the feed to the nitrogen-separation column can be subcooled liquid, rather than vapor as in the prior art, thereby reducing condenser duty to that column. Further, the higher pressure nitrogen column with its higher condenser temperature increases the minimum pressure in a CO heat pump thereby reducing the compression required in the heat pump cycle enabling a smaller compressor to be use with the attendant lower capital cost. The capital cost also is reduced where argon removal is desired, since, for most carbon monoxide uses, there is no need for an additional column for argon separation. When the gaseous mixture comprises argon, it can be separated from carbon monoxide in the methane-separation column and removed therefrom with the methane bottoms liquid.

The present invention also differs from the prior art by facilitating the use of liquid nitrogen to strip carbon monoxide from nitrogen-enriched overheads from the nitrogen separation column thereby providing refrigeration and simultaneously reducing the loss of carbon monoxide with the nitrogen-enriched stream. This can be particularly beneficial when hydrogen is required at high pressure, or when the cost of an expander is not justified and liquid nitrogen is available cheaply, for example from an adjacent air separation plant.

In accordance with the present invention, product carbon monoxide is delivered from the top of the methane-separation column and reflux can be provided by direct introduction of a liquefied carbon monoxide heat pump stream, as is conventional for a methane-separation column in a partial condensation or methane wash cold box.

Usually, the gaseous feed is partially condensed to provide the vapor feed portion and a CO-enriched liquid feed fraction which suitably is fed to the hydrogen-stripping step.

A portion of the nitrogen-enriched vapor overheads from the nitrogen-separation column usually is condensed against a CO recycle heat pump stream to provide reflux to the column. Suitably, the recycle heat pump circuit comprises warming a portion of the CO product overheads vapor from the methane-separation column by heat exchange against one or more process streams; compressing the warmed stream; at least partially condensing the compressed stream by heat exchange against one or more process streams; separating the resultant condensed recycle fraction into at least two portions of which one portion is vaporized against condensing overheads vapor from the nitrogen-separation column and another portion is fed as reflux to the methane-separation column.

It is preferred that a portion of the nitrogen-enriched vapor overheads from the nitrogen-separation column is washed with liquid nitrogen to remove carbon monoxide therefrom and provide reflux to the column.

Usually, the methane bottoms liquid from the methane-separation is recycled as the methane wash liquid.

The following is a description, by way of example only and with reference to the accompanying drawings, of two presently preferred embodiments of the present invention.

Referring first to FIG. 1, crude synthesis gas is introduced via conduit 1, cooled in heat exchanger 2, and further cooled and partially condensed in heat exchanger 3. The partially condensed mixture is separated in separator 4 to provide vapor and liquid fractions in conduits 5 and 6 respectively. The vapor in conduit 5 is fed to a methane wash column 8 where it is washed with liquid methane to dissolve the carbon monoxide into a CO-loaded bottoms liquid which is removed in conduit 13. Heat exchanger 9 removes the heat of solution of carbon monoxide in methane from the column.

Overheads vapor from the methane wash column 8 is removed in conduit 12, warmed in heat exchangers 37, and 2, and leaves the plant as hydrogen rich product in conduit 54. This may be further processed, for example in a pressure swing adsorber, to provide a pure hydrogen product. Excess hydrogen from column 8 is reduced in pressure by control valve 11 and mixed with other streams as described below to provide fuel gas 53.

Bottoms liquid in conduit 13 is reduced in pressure by control valve 10, and introduced into hydrogen stripping column 15. The liquid fraction in conduit 6 from the feed separator 4 is reduced in pressure by control valve 7 and also introduced into column 15. Although these feeds to column 15 are shown to be below the section containing trays or packing, it is preferred that they will be a few stages above the bottom of the section. Reboiler 16 at the bottom of column 15 provides stripping vapor for the liquid whereby hydrogen is stripped out as the vapor passes over trays or packing in column 15. Reboiler duty is accomplished by indirect heat exchange with a CO recycle heat pump stream and the feed gas mixture. This is accomplished in heat exchanger 3 but may be performed in a separate reboiler heat exchanger. Liquid methane in conduit 14 from an intermediate location of methane wash column 8 is reduced in pressure by control valve 17 and provides reflux for the column 15.

Hydrogen-stripped CO-loaded methane is removed as bottoms liquid from hydrogen stripping column 15 in conduit 18, subcooled in heat exchanger 3, reduced in pressure by control valve 21, and introduced into nitrogen-separation fractionation column 22. This liquid feed is separated in column 22 into a nitrogen-containing overheads vapor removed in conduit 25, and a nitrogen-freed CO-loaded ethane bottoms liquid removed in conduit 26. Column 22 is reboiled by bottom reboiler 23 and reflux is provided by top condenser 24. Reboiler duty is accomplished by indirect heat exchange with the CO recycle heat pump stream and the feed gas mixture. This is accomplished in heat exchanger 3 but may be performed in a separate reboiler heat exchanger.

Bottoms liquid in conduit 26 is subcooled in heat exchanger 3 and split into two fractions. The first fraction in conduit 31 is reduced in pressure by control valve 28 and fed to methane-separation fractionation column 32. The second fraction is reduced in pressure by control valve 29, partially vaporised in heat exchanger 3, and introduced via conduit 30 into methane-separation column 32 several stages below the first liquid fraction. These feeds are separated in column 32 into CO product overheads vapor removed in conduit 35 and methane bottoms liquid removed in conduit 36. Column 32 is reboiled by bottom reboiler 33 and reflux is provided by direct introduction of liquid carbon monoxide via control valve 34. Reboiler duty is accomplished by indirect heat exchange with the CO recycle heat pump stream and the feed gas mixture. This is accomplished in heat exchanger 2 but may be performed in a separate reboiler heat exchanger.

Bottoms liquid in conduit 36 is subcooled in heat exchanger 37, pumped to higher pressure in pump 38, and fed as methane reflux to methane wash column 8. Any excess bottoms liquid is reduced in pressure through control valve 39, combined with other fuel streams, warmed in heat exchangers 3 and 2, and removed from the plant as low pressure fuel in conduit 53.

The CO recycle heat pump stream is provided from multistage compressor 40 via conduits 42 and 43. Intermediate pressure CO stream in conduit 42 is cooled in heat exchanger 2, further cooled and condensed in heat exchanger 3, and subcooled in heat exchanger 37. High pressure CO stream in conduit 43 is partially cooled in heat exchanger 2 and split into two substreams. The first substream is expanded to an intermediate pressure in expander 45 and sent via conduit 46 to heat exchanger 3 for further cooling and condensing, and subcooled in heat exchanger 37. The second substream is further cooled and condensed in heat exchanger 2, and subcooled in heat exchanger 37. The three subcooled condensed heat pump streams from heat exchanger 37 are reduced in pressure by control valves 47, 48, and 49 respectively and combined to provide reflux for methane-separation column 32 and condenser duty for nitrogen-separation column 22 by indirect heat exchange in condenser 24, and to remove the heat of solution from methane wash column 8. Vaporised CO heat pump streams from condenser 24 and heat exchanger 9 are mixed with the CO product vapor overheads in conduit 35. The combined stream is warmed in heat exchangers 37 and 2, and delivered via conduit 41 to the suction side of compressor 40. A portion of the compressed stream is withdrawn from an intermediate stage of compressor 40 to provide a CO product stream which is delivered via conduit 44. The remainder of the compressed stream is recycled via conduits 42 and 43 as described above.

Hydrogen-enriched overheads vapor in conduit 19 from hydrogen stripping column 15 and nitrogen-containing overheads vapor in conduit 25 from nitrogen-separation column 22 are reduced in pressure by control valves 20 and 27 respectively, mixed with the excess hydrogen from wash column 8 and the excess methane bottoms liquid from methane-separation column 32, vaporised in heat exchanger 3, then warmed in heat exchanger 2 to be delivered as fuel gas in conduit 53.

Table 1 summarises a mass balance for a typical application of the embodiment of FIG. 1.

Figure 2:
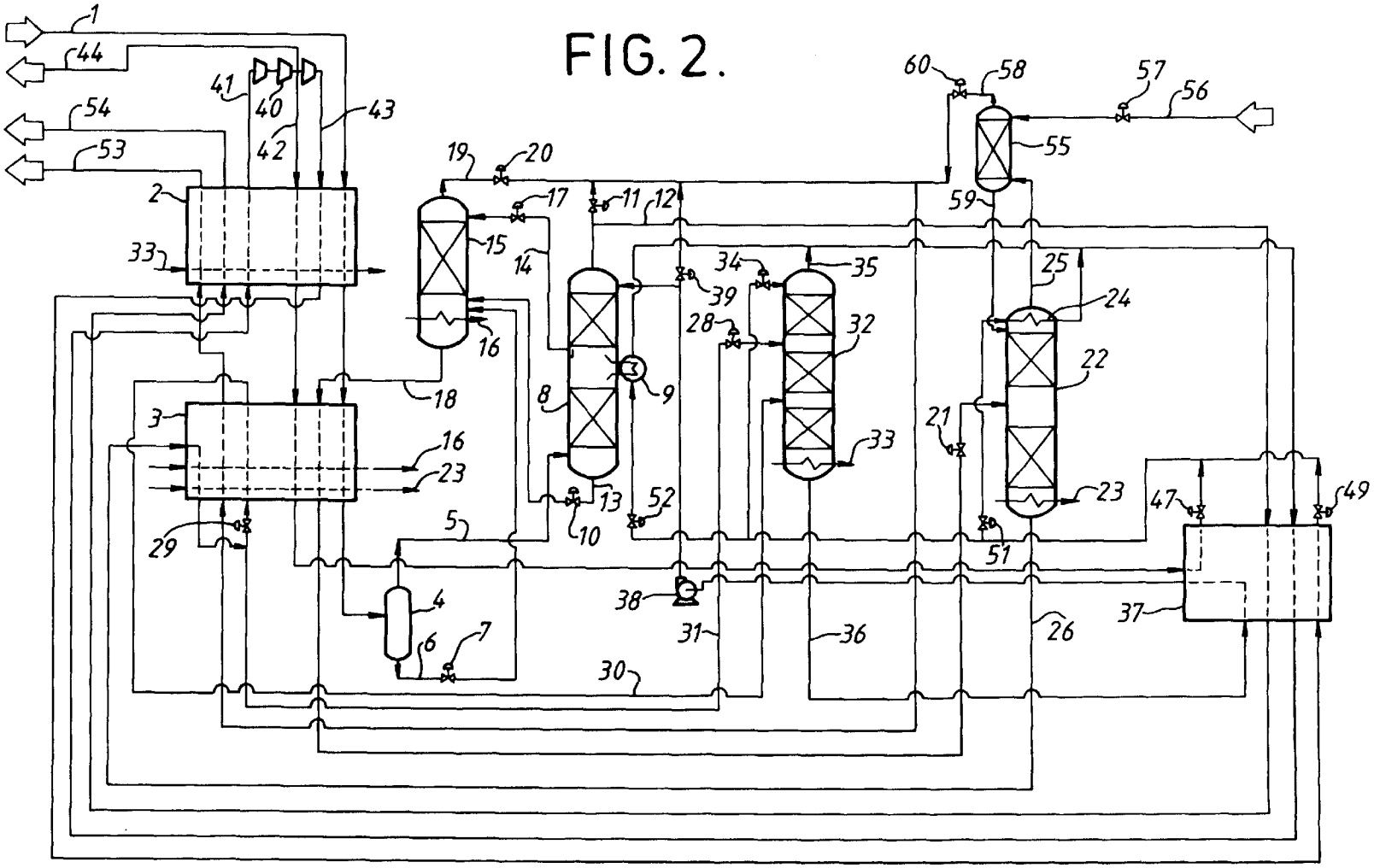

By comparison, the synthesis gas feed in the exemplified processes of DE-A-19541339 contains 51.5 mol % CO, 47.5 mol % hydrogen, 0.8 mol % methane and 0.2 mol % nitrogen (hydrogen:CO molar ratio=0.92) and is fed to the process at the rate of about 330 kmol/h (170 kmol CO) and a pressure of about 20 bar (2000 kPa). About 52 mol % (170 kmol/h) of the feed is removed as the hydrogen-rich vapor fraction containing 12.5 mol % CO and at a pressure of about 20 bar (2000 kPa). About 44 mol % (140 kmol/h) of the feed is removed as pure (99.9%) CO at a pressure of about 2 bar (200 kPa) in the embodiment of FIG. 1 (4 bar (400 kPa) after initial heat pump compression), about 1.5 bar (150 kPa) in the embodiment of FIG. 2 or about 3 bar (300 kPa) in the embodiment of FIG. 3 (the foregoing figures 1–3 are the figures shown in DE-A-19541339. The balance (20 kmol/h) of the feed is removed as a heating gas containing 32.5% CO also at a pressure of about 1.5 bar (150 kPa).

TABLE 1

| | | Stream | | | | | | |
|---|---|---|---|---|---|---|---|---|
| | | 1 | 5 | 6 | 12 | 13 | 14 | 18 |
| Pressure | bar abs | 22 | 21 | 21 | 21 | 21 | 21 | 11 |
| | kPa | 2200 | 2100 | 2100 | 2100 | 2100 | 2100 | 1100 |
| Temperature | deg C. | 10 | −167 | −167 | −170 | −169 | −178 | −147 |
| Flowrate | kgm/h | 1270 | 1230 | 40 | 1010 | 580 | 40 | 650 |
| Hydrogen | mol % | 78.4 | 80.9 | 2.2 | 96.0 | 2.4 | 1.8 | 0.1 |
| Nitrogen | mol % | 0.8 | 0.8 | 0.8 | 0.3 | 1.2 | 1.0 | 1.2 |
| Carbon monoxide | mol % | 15.0 | 14.7 | 24.8 | 0.5 | 30.0 | 7.2 | 28.8 |
| Methane | mol % | 5.7 | 3.5 | 72.1 | 3.2 | 66.4 | 90.0 | 69.9 |
| Vapor fraction | | 1 | 1 | 0 | 1 | 0 | 0 | 0 |

| | | Stream | | | | | | |
|---|---|---|---|---|---|---|---|---|
| | | 19 | 25 | 26 | 30 | 31 | 35 | 36 |
| Pressure | bar abs | 11 | 4 | 5 | 3 | 5 | 3 | 3 |
| | kPa | 1100 | 400 | 500 | 300 | 500 | 300 | 300 |
| Temperature | deg C. | −174 | −180 | −161 | −161 | −167 | −182 | −147 |
| Flowrate | kgm/h | 20 | 10 | 640 | 320 | 310 | 180 | 450 |
| Hydrogen | mol % | 88.5 | 6.4 | 0.0 | 0.0 | 0.0 | 0.0 | 0.0 |
| Nitrogen | mol % | 1.9 | 58.4 | 0.0 | 0.0 | 0.0 | 0.1 | 0.0 |
| Carbon monoxide | mol % | 6.3 | 35.3 | 28.7 | 28.7 | 28.7 | 99.9 | 0.3 |
| Methane | mol % | 3.3 | 0.0 | 71.3 | 71.3 | 71.3 | 0.0 | 99.7 |
| Vapor fraction | | 1 | 1 | 0 | 0.3 | 0 | 1 | 0 |

| | | Stream | | | | | | |
|---|---|---|---|---|---|---|---|---|
| | | 41 | 42 | 43 | 44 | 46 | 53 | 54 |
| Pressure | bar abs | 3 | 13 | 27 | 13 | 10 | 2 | 21 |
| | kPa | 300 | 1300 | 2700 | 1300 | 1000 | 200 | 2100 |
| Temperature | deg C. | 18 | 39 | 39 | 39 | −142 | 18 | 18 |
| Flowrate | kgm/h | 900 | 230 | 500 | 180 | 190 | 80 | 1010 |
| Hydrogen | mol % | 0.0 | 0.0 | 0.0 | 0.0 | 0.0 | 34.6 | 96.1 |
| Nitrogen | mol % | 0.1 | 0.1 | 0.1 | 0.1 | 0.1 | 9.2 | 0.3 |
| Carbon monoxide | mol % | 99.9 | 99.9 | 99.9 | 99.9 | 99.9 | 6.8 | 0.5 |
| Methane | mol % | 0.0 | 0.0 | 0.0 | 0.0 | 0.0 | 49.4 | 3.2 |
| Vapor fraction | | 1 | 1 | 1 | 1 | 1 | 1 | 1 |

FIG. 2 illustrates an embodiment of the invention which is particularly beneficial when only a small amount of external refrigeration is required for the process. Features common with the embodiment of FIG. 1 are identified by the same reference numerals and only the differences between the two embodiments will be described.

The CO recycle stream expander 45 of FIG. 1 is omitted and the entire CO high pressure stream 43 from compressor 41 is cooled and condensed in heat exchanger 2, subcooled in heat exchanger 37 and reduced in pressure through valve 49.

The nitrogen-containing overheads vapor in conduit 25 from the nitrogen-separation column 22 is introduced into column 55, which is refluxed with liquid nitrogen introduced via conduit 56 and control valve 57. Bottoms liquid is returned via conduit 50 to the nitrogen-separation column 22 and overheads vapor is mixed with the other streams providing fuel gas 53. The provision of column 55 not only provides the refrigeration requirement provided by expander 45 in FIG. 1 but also recovers carbon monoxide from the nitrogen-containing overheads vapor as it rises through the trays or packing of the column 55.

Table 2 summarizes a mass balance for a typical application of the embodiment of FIG. 2.

reflux of the methane-separation column 32. This is convenient when the heat pump system is integrated with product carbon monoxide compression. In cases where the product compressor is separate, or only low pressure carbon monoxide is required, the heat pump duty could be supplied by some other heat pump fluid, such as nitrogen, by adding a condenser to column 32 to provide reflux by indirect heat exchange. In the case of a nitrogen heat pump, the liquid nitrogen described in FIG. 2 could be provided from the heat pump system and refrigeration provided by a hydrogen, carbon monoxide, or nitrogen expander or auxiliary liquid nitrogen.

Reboiler duties for nitrogen- and methane-separation columns 22 and 32 can be accomplished in separate reboiler heat exchangers by indirect heat exchange with the CO heat pump stream alone.

TABLE 2

| | | Stream | | | | | | | |
|---|---|---|---|---|---|---|---|---|---|
| | | 1 | 5 | 6 | 12 | 13 | 14 | 18 | 19 |
| Pressure | bar abs | 22 | 21 | 21 | 21 | 21 | 21 | 12 | 12 |
| | kPa | 2200 | 2100 | 2100 | 2100 | 2100 | 2100 | 1200 | 1200 |
| Temperature | deg C. | 10 | −167 | −167 | −171 | −170 | −178 | −148 | −176 |
| Flowrate | kgm/h | 1270 | 1230 | 40 | 1020 | 510 | 40 | 580 | 10 |
| Hydrogen | mol % | 78.4 | 81.2 | 2.3 | 95.8 | 2.4 | 1.8 | 0.2 | 90.0 |
| Nitrogen | mol % | 0.8 | 0.8 | 0.9 | 0.3 | 1.3 | 1.1 | 1.2 | 1.4 |
| Carbon monoxide | mol % | 15.0 | 14.7 | 25.5 | 0.9 | 33.0 | 10.1 | 31.6 | 6.5 |
| Methane | mol % | 5.7 | 3.4 | 71.4 | 3.0 | 63.3 | 87.0 | 67.0 | 2.4 |
| Vapor fraction | | 1 | 1 | 0 | 1 | 0 | 0 | 0 | 1 |

| | | Stream | | | | | | | |
|---|---|---|---|---|---|---|---|---|---|
| | | 25 | 26 | 30 | 31 | 35 | 36 | 41 | 42 |
| Pressure | bar abs | 5 | 5 | 3 | 5 | 3 | 3 | 3 | 13 |
| | kPa | 500 | 500 | 300 | 500 | 0300 | 300 | 300 | 1300 |
| Temperature | deg C. | −180 | −162 | −148 | −167 | −182 | −147 | 18 | 39 |
| Flowrate | kgm/h | 30 | 570 | 100 | 470 | 180 | 390 | 900 | 460 |
| Hydrogen | mol % | 5.5 | 0.0 | 0.0 | 0.0 | 0.0 | 0.0 | 0.0 | 0.0 |
| Nitrogen | mol % | 75.0 | 0.0 | 0.0 | 0.0 | 0.1 | 0.0 | 0.1 | 0.1 |
| Carbon monoxide | mol % | 19.5 | 31.9 | 31.9 | 31.9 | 99.9 | 0.3 | 99.9 | 99.9 |
| Methane | mol % | 0.0 | 68.0 | 68.0 | 68.0 | 0.0 | 99.7 | 0.0 | 0.0 |
| Vapor fraction | | 1 | 0 | 1 | 0 | 1 | 0 | 1 | 1 |

| | | Stream | | | | | | |
|---|---|---|---|---|---|---|---|---|
| | | 43 | 44 | 53 | 54 | 56 | 58 | 59 |
| Pressure | bar abs | 27 | 13 | 2 | 21 | 5 | 5 | 5 |
| | kPa | 2700 | 1300 | 200 | 2100 | 500 | 500 | 500 |
| Temperature | deg C. | 39 | 39 | 18 | 18 | −180 | −181 | −181 |
| Flowrate | kgm/h | 260 | 180 | 100 | 1020 | 20 | 30 | 20 |
| Hydrogen | mol % | 0.0 | 0.0 | 28.6 | 95.8 | 0.0 | 5.4 | 0.0 |
| Nitrogen | mol % | 0.1 | 0.1 | 25.0 | 0.3 | 100.0 | 91.1 | 75.2 |
| Carbon monoxide | mol % | 99.9 | 99.9 | 2.2 | 0.9 | 0.0 | 3.6 | 24.7 |
| Methane | mol % | 0.0 | 0.0 | 44.2 | 3.0 | 0.0 | 0.0 | 0.0 |
| Vapor fraction | | 1 | 1 | 1 | 1 | 0 | 1 | 0 |

Numerous modifications and variations can be made to the embodiments of FIGS. 1 and 2 without departing from the scope and spirit of present invention. For example, the bottoms liquid from nitrogen-separation column 22 could be divided without any subcooling to provide a saturated liquid portion, which is reduced in pressure and fed to methane-separation column 32 a few equilibrium stages above the remainder of said bottoms liquid, which is at least partially vaporised in heat exchanger 3.

Distillation energy for the process of FIGS. 1 and 2 is provided by the CO recycle heat pump system, and direct

What we claim is:

1. A process for separating carbon monoxide ("CO") from a gaseous feed containing carbon monoxide, hydrogen, methane and nitrogen by cryogenic separation in which:

carbon monoxide is scrubbed from a vapor portion of the feed by a liquid methane wash to provide a CO-loaded liquid methane stream and a hydrogen-rich vapor;

dissolved hydrogen is stripped from said CO-loaded liquid methane stream to provide a hydrogen-stripped CO-loaded liquid methane stream;

said hydrogen-stripped CO-loaded liquid methane stream is fractionated into nitrogen-containing overheads vapor and nitrogen-freed bottoms liquid; and said nitrogen-freed bottoms liquid is fractionated into CO product overheads vapor and methane bottoms liquid.

2. The process claimed in claim 1, wherein the methane content of the gaseous mixture is at least about 1 mol-%.

3. The process claimed in claim 1, wherein the hydrogen:CO molar ratio in the feed gas is above about 2.5:1.

4. The process claimed in claim 3, wherein the hydrogen:CO molar ratio in the feed gas is about 3:1 to about 6:1.

5. The process claimed in claim 1, wherein the gaseous mixture is partially condensed to provide said vapor feed portion and a CO-enriched liquid feed fraction.

6. The process claimed in claim 5, wherein the CO-enriched liquid feed fraction is fed to the hydrogen-stripping step.

7. The process claimed in claim 1, wherein methane bottoms liquid from the methane-separation fractionation is recycled as the methane wash liquid.

8. The process claimed in claim 1, wherein a portion of the nitrogen-containing overheads vapor is condensed against a CO recycle heat pump stream to provide reflux to the nitrogen-separation fractionation.

9. The process claimed in claim 1, wherein a portion of the nitrogen-containing overheads vapor is washed with liquid nitrogen to remove carbon monoxide therefrom and provide reflux to the nitrogen-separation fractionation.

10. The process claimed in claim 1, wherein the gaseous feed consists essentially of carbon monoxide, hydrogen and methane contaminated with nitrogen.

11. The process claimed in claim 1, wherein the gaseous mixture comprises argon which is separated from carbon monoxide in the methane-separation fractionation and removed therefrom with the methane bottoms liquid.

12. An apparatus for separating carbon monoxide from a gaseous mixture containing carbon monoxide, hydrogen, methane and nitrogen by a process as defined in claim 1, said apparatus comprising:

a scrubbing column constructed and arranged to scrub carbon monoxide from the vapor portion of the feed by the liquid methane wash to provide the CO-loaded liquid methane stream and the hydrogen-rich vapor;

a stripping column constructed and arranged to strip dissolved hydrogen from the CO-loaded liquid methane stream to provide the hydrogen-stripped CO-loaded liquid methane stream;

a nitrogen-separation fractionation column constructed and arranged to separate nitrogen from the hydrogen-stripped CO-loaded liquid methane stream into the nitrogen-containing overheads vapor and the nitrogen-freed bottoms liquid; and a methane-separation fractionation column constructed and arranged to separate the nitrogen-freed bottoms liquid into the CO product overheads vapor and the methane bottoms liquid.

13. The apparatus claimed in claim 12, further comprising:

a heat exchanger constructed and arranged to partially condense the gaseous mixture to provide the vapor feed portion and a CO-enriched liquid feed fraction;

a conduit constructed and arranged to feed the CO-enriched liquid feed fraction to the hydrogen-stripping column; and a conduit constructed and arranged to recycle methane bottoms liquid from the methane-separation fractionation column to the scrubbing column to provide the methane wash.

14. The apparatus claimed in claim 12, further comprising a CO washing column constructed and arranged to recover carbon monoxide from a portion of the nitrogen-containing overheads vapor with liquid nitrogen and a conduit constructed and arranged to return the resultant CO-loaded liquid nitrogen as reflux to the nitrogen-separation fractionation column.

15. A process for cryogenically separating carbon monoxide ("CO") from a gaseous feed consisting essentially of carbon monoxide, hydrogen in a hydrogen:CO molar ratio of above about 2.5:1, and at least about 1 mol-% methane and contaminated with a contaminant selected from the group consisting of nitrogen and nitrogen with argon, said process comprising:

partially condensing the gaseous mixture to provide a vapor feed portion and a CO-enriched liquid feed fraction;

scrubbing CO from said vapor feed portion by a liquid methane wash to provide a CO-loaded liquid methane stream and a hydrogen-rich vapor;

stripping dissolved hydrogen from said CO-loaded liquid methane stream and said CO-enriched liquid feed fraction to provide a hydrogen-stripped CO-loaded liquid methane stream;

fractionating said hydrogen-stripped CO-loaded liquid methane stream into nitrogen-containing overheads vapor and nitrogen-freed bottoms liquid;

fractionating said nitrogen-freed bottoms liquid into CO product overheads vapor and methane bottoms liquid; and recycling said methane bottoms liquid as the methane wash liquid.

16. The process claimed in claim 12, wherein a portion of the nitrogen-containing overheads vapor is washed with liquid nitrogen to remove carbon monoxide therefrom and provide reflux to the nitrogen-separation fractionation.

* * * * *